US008655242B2

(12) United States Patent
Tanaka

(10) Patent No.: US 8,655,242 B2
(45) Date of Patent: Feb. 18, 2014

(54) IMAGE HEATING DEVICE

(75) Inventor: Kenichi Tanaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 235 days.

(21) Appl. No.: 13/187,902

(22) Filed: Jul. 21, 2011

(65) Prior Publication Data

US 2012/0027476 A1 Feb. 2, 2012

(30) Foreign Application Priority Data

Jul. 29, 2010 (JP) ..... 2010-170514

(51) Int. Cl.
*G03G 15/20* (2006.01)

(52) U.S. Cl.
USPC ..... 399/323; 399/159; 399/249; 399/329

(58) Field of Classification Search
USPC ..... 399/159, 176, 249, 323, 329
See application file for complete search history.

(56) References Cited

U.S. PATENT DOCUMENTS

| | | | | |
|---|---|---|---|---|
| 5,525,775 | A | 6/1996 | Setoriyama et al. | |
| 7,139,515 | B2 * | 11/2006 | Yamamoto et al. | 399/251 |
| 2009/0263163 | A1 * | 10/2009 | Sandler et al. | 399/249 |
| 2009/0279928 | A1 | 11/2009 | Ishikawa | |

FOREIGN PATENT DOCUMENTS

| | | | |
|---|---|---|---|
| JP | 3-67362 | U | 7/1991 |
| JP | 4-44075 | | 2/1992 |
| JP | 2000-89603 | A | 3/2000 |
| JP | 2007-240921 | A | 9/2007 |
| JP | 2008-3277 | A | 1/2008 |
| JP | 2009-271345 | | 11/2009 |

OTHER PUBLICATIONS

Chinese Office Action dated Sep. 4, 2013, issued in counterpart Chinese Application No. 201110213948.1, and English-language translation thereof.

* cited by examiner

*Primary Examiner* — Walter L Lindsay, Jr.
*Assistant Examiner* — Roy Y Yi
(74) *Attorney, Agent, or Firm* — Fitzpatrick, Cella, Harper & Scinto

(57) ABSTRACT

An image heating device includes a rotatable image heating member for heating an image on a recording material and for forming a nip; a blowing member for blowing air; and an ejecting member for ejecting air to separate the recording material passing through the nip from the image heating member, the ejecting member ejecting the air from the blowing member toward the image heating member so that the speed of the air toward an end portion of the image heating member is higher than that of the air toward a central portion of the image heating member with respect to a rotational axis direction of the image heating member.

12 Claims, 10 Drawing Sheets

(A)

(B)

(A)

(B)

(A)

(B)

IMAGE HEATING DEVICE

FIELD OF THE INVENTION AND RELATED ART

The present invention relates to an image heating device, used in an image forming apparatus such as a copying machine or a printer, for fixing on a recording material a toner image formed on the recording material.

In a conventional image forming apparatus, a latent image is formed at an image forming portion by using light, magnetism, electric charge or the like, and then the latent image is developed to form a visible image. Then, the visible image is transferred onto a transfer material, conveyed to the image forming portion by a transfer material conveying means, by using an electrostatic force and the transferred visible image is fixed on the transfer material by heat in a fixing device to obtain an image on the transfer material. Specifically, in a color image forming apparatus of an electrophotographic type, the latent image is formed for every color on a photosensitive drum, which is an image bearing member. The resultant latent images are developed into developer images by a plurality of developing devices and then the developer images are intermediary-transferred successively onto an intermediary transfer belt, as an endless belt held by a transfer device to obtain color images. Thereafter, the color images are collectively transferred onto transfer paper or the like (transfer material) to obtain a desired color image. In this type of apparatus, the conveying path of the transfer material is similar to that in the case of single developer image, so that the number of types of transfer materials compatible with the type of apparatus is large and there are many techniques which can be commonly applicable in terms of mechanisms. Therefore, it is possible to easily realize downsizing and a price-reduction of the apparatus.

Further, from the viewpoints of quick start and energy saving as a fixing device, the fixing device using an endless belt as a fixing belt has been known (Japanese Laid-Open Application Hei 4-44075). When such an endless belt is stretched, a lateral shifting force is generated anyhow toward either one of left and right belt end portions with respect to a belt-axis direction, so that the belt meanders or is laterally shifted to one direction.

In the above-described fixing method using the endless belt, problems occur, such as the conveyance of the recording material becoming unstable by the lateral belt shifting toward a belt width direction, generating creases on the recording material, and the belt being pressed against a regulating (preventing) member by the lateral shifting force exerted on the belt to rub against the regulating member, thus breaking the belt.

In the conventional image forming apparatus, separation of the recording material is performed with a trigger such that the recording material is separated from a fixing member at its central portion with respect to a conveyance-width direction. Further, it takes much time until the separated portion reaches end portions of the recording material, so that a state occurs for a certain period of time in which the recording material is separated at the central portion but is still stuck on a fixing roller. For this reason, a difference in glossiness occurs. That is, when the contact time of the recording material to the fixing roller is long, the glossiness is enhanced, but a distribution of the contact time is caused to result in an image defect.

SUMMARY OF THE INVENTION

A principal object of the present invention is to provide a fixing device (image heating device) including an air separation constitution capable of improving a separating property of a recording material even with a small volume of air.

According to an aspect of the present invention, there is provided an image heating device comprising:

a rotatable image heating member for heating an image on a recording material and for forming a nip;

blowing means for blowing air; and ejecting means for ejecting air to separate the recording material passing through the nip from the image heating member, the ejecting means ejecting the air from the blowing means toward the image heating member so that the speed of the air toward an end portion of the image heating member is higher than that of the air toward a central portion of the image heating member with respect to a rotational axis direction of the image heating member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
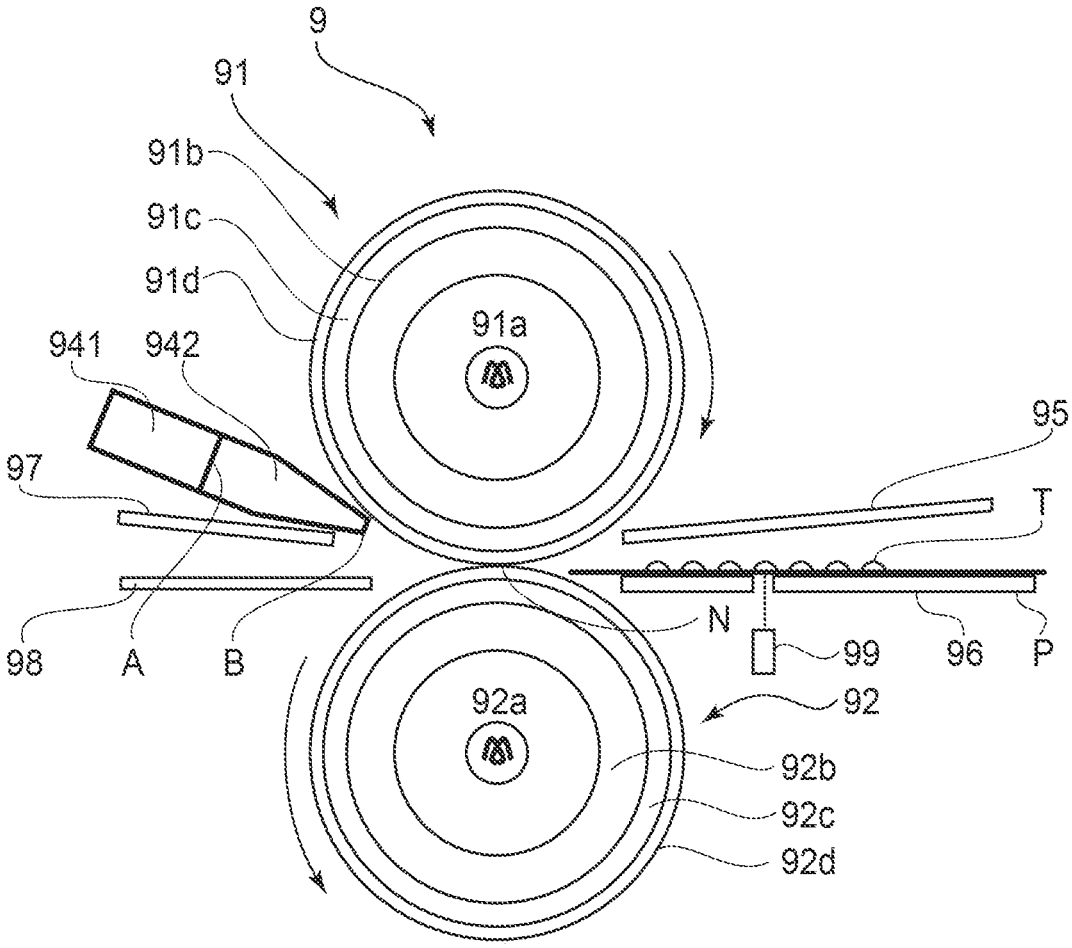
FIG. 1 is a sectional view of a fixing device provided with a separating means in First Embodiment of the present invention.

Embodiments of the present invention will be described below with reference to the drawings. Incidentally, in all the figures in the following embodiments, the same or corresponding portions are represented by the same reference numerals or symbols.

First Embodiment (Image Forming Apparatus)

Figure 2:
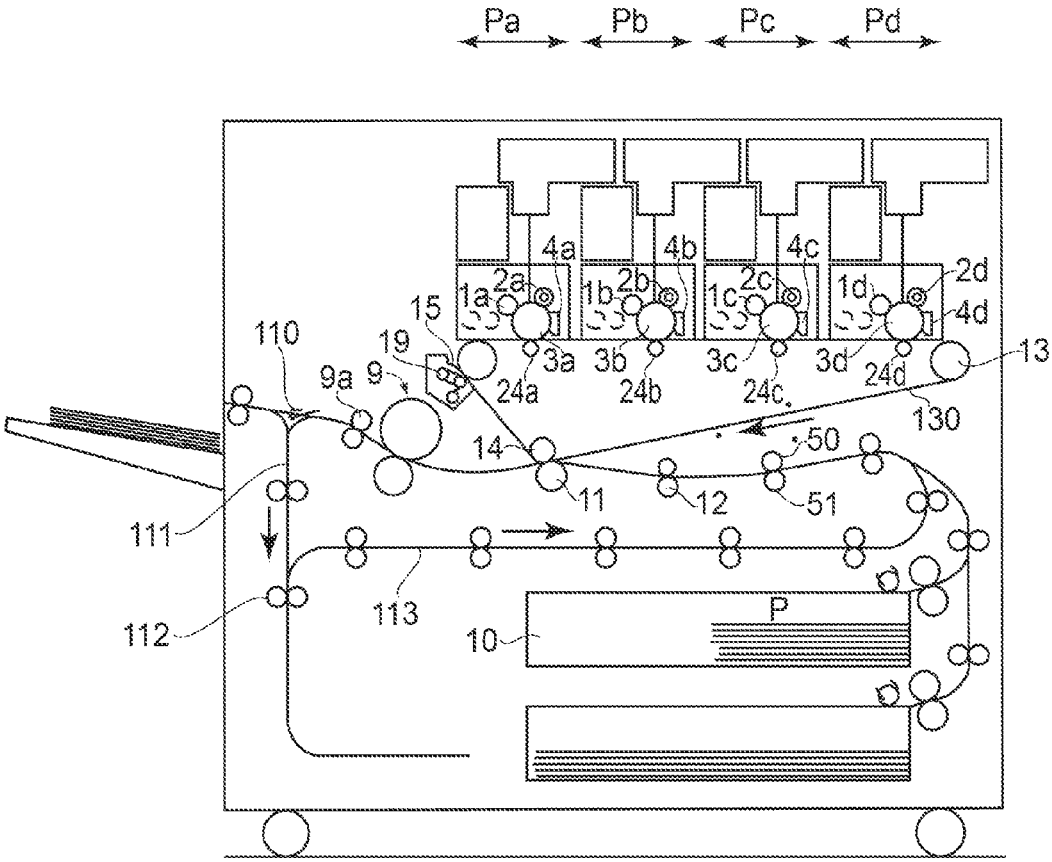
FIG. 2 is a sectional views of an image forming apparatus using the fixing device according to the present invention.

In an image forming apparatus shown in FIG. 2, first to fourth image forming portions Pa, Pb, Pc and Pd are juxtaposed and toner images of different colors (yellow, magenta, cyan and black) are formed through a process including latent image formation, development and transfer. The image forming portions Pa, Pb, Pc and Pd include dedicated image bearing members, i.e., electrophotosensitive drums 3*a*, 3*b*, 3*c* and 3*d*, respectively, in this embodiment, and on each of the drums 3*a*, 3*b*, 3*c* and 3*d*, an associated color toner image is formed. Adjacent to the respective drums 3*a*, 3*b*, 3*c* and 3*d*, an intermediary transfer member 130 stretched by rollers 13, 14 and 15 is provided. The respective color toner images formed on the drums 3*a*, 3*b*, 3*c* and 3*d* are primary-transferred onto the intermediary transfer member 130 and then are transferred onto a recording material P at a secondary transfer portion. Further, the recording material P on which the toner images are transferred is subjected to fixing the toner images by a fixing portion 9 under heat and pressure and thereafter is discharged to the outside of the image forming apparatus as a recording image-formed product.

At peripheries of the drums 3*a*, 3*b*, 3*c* and 3*d*, drum chargers 2*a*, 2*b*, 2*c* and 2*d*, developing devices 1*a*, 1*b*, 1*c* and 1*d*, primary transfer chargers 24*a*, 24*b*, 24*c* and 24*d*, and cleaners 4*a*, 4*b*, 4*c* and 4*d* are provided. Further, at an upper portion in the image forming apparatus, a light-source device and a polygon mirror which are not shown are provided. Laser light from the light source device is used for scanning the drum surface while rotating the polygon mirror, and then light fluxes of the scanning light are deflected by a reflection mirror and are focused on a generating line of each of the drums 3*a*, 3*b*, 3*c* and 3*d* by fθ lens, so that the drum surface is exposed to light. Thus, on each of the drums 3*a*, 3*b*, 3*c* and 3*d*, the latent image depending on an image signal is formed.

In the developing devices 1*a*, 1*b*, 1*c* and 1*d*, as developers, toners of yellow, magenta, cyan and black, respectively, are filled in a predetermined amount by unshown supplying devices. The developing devices 1*a*, 1*b*, 1*c* and 1*d* develop the latent images on the drums 3*a*, 3*b*, 3*c* and 3*d*, respectively, to visualize the latent images as a yellow toner image, a magenta toner image, a cyan toner image and a black toner image, respectively.

The intermediary transfer member 130 is rotationally driven in an arrow direction at the same peripheral speed as those of the drums (3*a*, 3*b*, 3*c*, 3*d*). The yellow toner image for a first color formed and carried on the drum 3*a* is intermediary-transferred onto an outer peripheral surface of the intermediary transfer member 130 by pressure and an electric field generated by a primary transfer bias applied to the intermediary transfer member 130 in a process in which the yellow toner image passes through a nip between the drum 3*a* and the intermediary transfer member 130. A secondary transfer roller 11 is shaft-supported in parallel and correspondingly to the intermediary transfer member 130 and is disposed in contact with a lower surface portion of the intermediary transfer member 130. To the secondary transfer roller 11, a desired secondary transfer bias is applied by a secondary transfer bias voltage source. A synthetic color toner image obtained by transferring the color toner images onto the intermediary transfer member 130 superposedly is transferred onto the recording material P in the following manner. That is, the recording material P is fed from a sheet feeding cassette 10 and passes through a registration roller 12 and a pre-transfer guide to be conveyed into a contact nip between the intermediary transfer member 130 and the secondary transfer roller 11 with predetermined timing and at the same time the secondary transfer bias is applied from the bias voltage source. By this secondary transfer bias, the synthetic color toner image is transferred from the intermediary transfer member 130 onto the recording material P. Similarly as in the case of the yellow toner image for the first color, a magenta toner image for a second color, a cyan toner image for a third color and a black toner image for a fourth color are successively transferred superposedly onto the intermediary transfer member 130, so that the synthetic color toner image corresponding to an objective color image is formed. The synthetic color toner image is formed while leaving certain margins from four edges of the recording material P. In this embodiment, a leading end margin is about 2-3 mm.

Transfer residual toners on the drums 3*a*, 3*b*, 3*c* and 3*d* from which the primary transfer is ended are removed from the drums by the cleaners 4*a*, 4*b*, 4*c* and 4*d*, respectively, and then the drums 3*a*, 3*b*, 3*c* and 3*d* prepare for subsequent latent image formation. Foreign matter, such as toner and the like which remain on the transfer belt (intermediary transfer member) 130 are wiped with a cleaning web (nonwoven fabric) 19 by bringing the cleaning web 19 into contact to the surface of the transfer belt 130.

The recording material P subjected to the toner-image transfer is successively introduced into the fixing device 9, by which heat and pressure are applied to the recording material P to fix the toner image on the recording material P.

In the case of both-side (surface) printing, the recording material P fed from the sheet feeding cassette 10 is subjected to one-side (surface) fixing by being passed through the registration roller 12, the pre-transfer guide and the contact nip between the intermediary transfer member 130 and the secondary transfer roller 11 and then by being subjected to the fixing by the fixing device 9, and then is introduced into a reverse path 111 by a flapper 110. Thereafter, the recording material P is reversed by a reversing roller 112 and then is guided into a both-side path 113. Then, the recording material P passes again the registration roller 12, the pre-transfer guide, and the contact nip between the intermediary transfer member 130 and the secondary transfer roller 11 to be subjected to the transfer on a second surface (the other surface) and is subjected to fixing by the fixing device 9 to complete the both-side fixing. Further, the direction of the flapper is switched during the both-side printing and the recording material P subjected to the both-side fixing is discharged to the outside of the image forming apparatus as a recording image-formed product.

(Fixing Device)

Next, a structure of the fixing device according to the present invention will be described with reference to FIGS. 1 to 6. In these figures, the same constituent elements are represented by the same reference numerals or symbols. In FIG. 1, the fixing device 9 includes a fixing roller 91, as a fixing member and a heating member, internally provided with a halogen heater 91*a* and includes a pressing roller 92, as an opposite member and a pressing member, internally provided with a halogen heater 92*a*. The fixing roller 91 is constituted by the halogen heater 91*a* provided at the center thereof, a metal core 91*b* formed of aluminum, iron or the like in a cylindrical shape, an elastic layer 91*c*, which is formed with a silicone rubber foam and is located on an outer peripheral surface of the metal core 91*b*, and a parting layer 91*d*. The parting layer 91*d* is formed with a tube of a fluorine-containing resin material such as PFA (tetrafluoroethylene-perfluoroalkylvinyl ether copolymer) or PTFE (polytetrafluoroethylene) and coats the outer peripheral surface of the elastic layer 91*c*. The thus-constituted fixing roller 91 has a roller outer diameter of about 70-90 mm.

The pressing roller 92 is constituted by the halogen heater 92*a* provided at the center thereof, a metal core 92*b* formed of aluminum, iron or the like in a cylindrical shape, and an elastic layer 92*c* which is formed with a silicone rubber foam and is located on an outer peripheral surface of the metal core 92*b*. Further, the pressing roller 92 includes a parting layer 92*d* for coating the outer peripheral surface of the elastic layer 92*d*. The parting layer 91*d* is formed with a tube of a fluorine-containing resin material such as PFA or PTFE and coats the outer peripheral surface of the elastic layer 92*c*. The pressing roller 92 has a roller outer diameter of about 50-70 mm and is urged by an unshown urging member, thus press-contacting the fixing roller 91 from below.

In the above constitution, when the fixing roller 91 is rotated by an unshown motor in the clockwise direction at a rotational speed of 50-80 rpm, the pressing roller 92 is rotated in the counterclockwise direction by the rotation of the fixing roller 91. Therefore, e.g., as shown in FIG. 1, the recording material P on which the toner image T is formed by the image forming apparatus is nip-conveyed in a fixing nip N formed by the fixing roller 91 and the pressing roller 92 to be heated and pressed, so that the toner image on the recording material is fixed. With respect to the heating and pressing, heating means for the fixing roller 91 and the pressing roller 92 are not limited to the halogen heater but may also be another heating member. Further, in place of the pressing roller, a pressing belt may also be used.

Incidentally, guide plates 95 and 96 for guiding entering of the recording material P into the fixing device 9 and guide plates 97 and 98 for guiding the recording material discharged from the fixing device 9 are provided.

At a downstream side of the fixing nip N with respect to the recording-material conveyance direction, an air blowing fan 941 and a duct 942, which are used as a gas introducing member disposed so as to blow the air toward the fixing nip N, are disposed.

An outlet-side opening B of the duct 942 is disposed at a position close to the surface of the fixing roller 91. Gas (which refers herein to the air as a representative example but may also be gas other than the air) blown from the air blowing fan 941 is configured to pass through the duct 941 and is blown toward the fixing nip N. This gas is blown to the leading end of the recording material P on which the toner image is fixed in the fixing nip N, so that the recording material stuck on the fixing roller 91 is separated.

Figure 3:
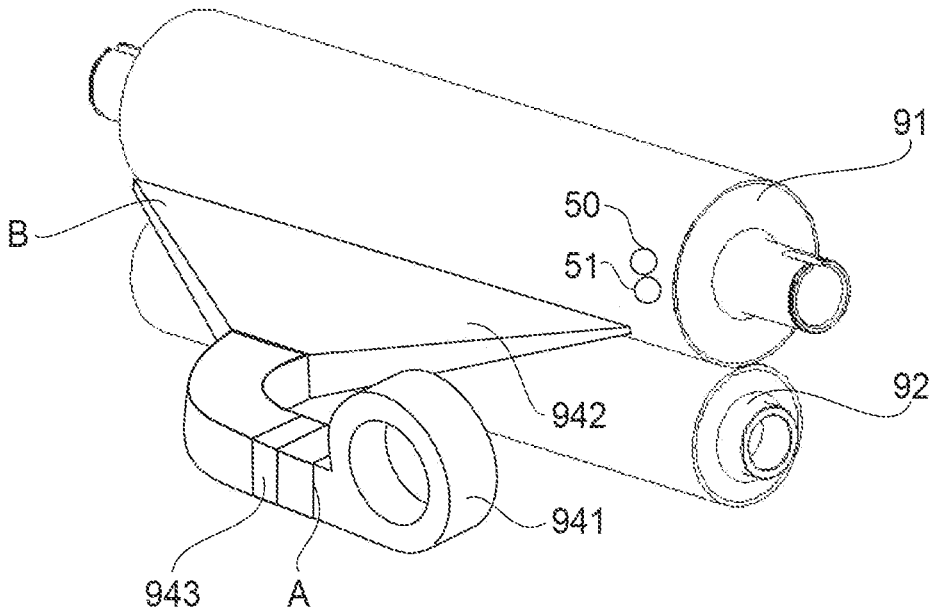
FIG. 3 is a perspective view of the fixing device provided with the separating means in First Embodiment of the present invention.

FIG. 3 is a perspective view of a recording-material separating mechanism in the present invention. The air blowing fan 941 is connected to an inlet-side opening A of the duct 942, and the gas sent from the air blowing fan 941 is blown from the outlet-side opening B to perform the separation of the recording material. The duct 942 extends toward the outlet-side opening blow in a sector shape. In addition, the duct 942 has a structure such that a width (height) of a duct flow path is gradually narrowed toward the outlet-side opening B, and the shape of the outlet-side opening B is a rectangular shape elongated in an axial direction of the fixing roller 91, by this shape. The gas blown from the air blowing fan 941 is narrowed in flow path from the inlet-side opening A toward the outlet-side opening B, so that the air spaced becomes high. The duct 942 is provided with a solenoid valve 943. When the gas is always blown from the duct 942, the fixing roller 91 is excessively cooled, so that there is a possibility that power consumption necessary to keep the surface temperature of the fixing roller 91 at a target temperature becomes large or that the surface temperature cannot be controlled. Therefore, as shown in FIG. 1, a distance sensor 99 is disposed upstream of the fixing nip N and detects timing when the recording material passes through the position thereof. The solenoid valve 942 is controlled so that the gas is blown from the duct 942 for a certain time from the detection. An opening time for which the solenoid valve 943 is opened is determined by adding a certain allowance to the length of the recording material with respect to the conveyance direction and a passing time of the recording material through the fixing nip N determined by the conveyance speed. For example, in the case where A3-sized recording material is conveyed with longitudinal feeding at a conveyance speed of 300 mm/sec, the opening time of the solenoid valve 942 may appropriately be about 1.5 to 2.0 sec.

Figure 4:
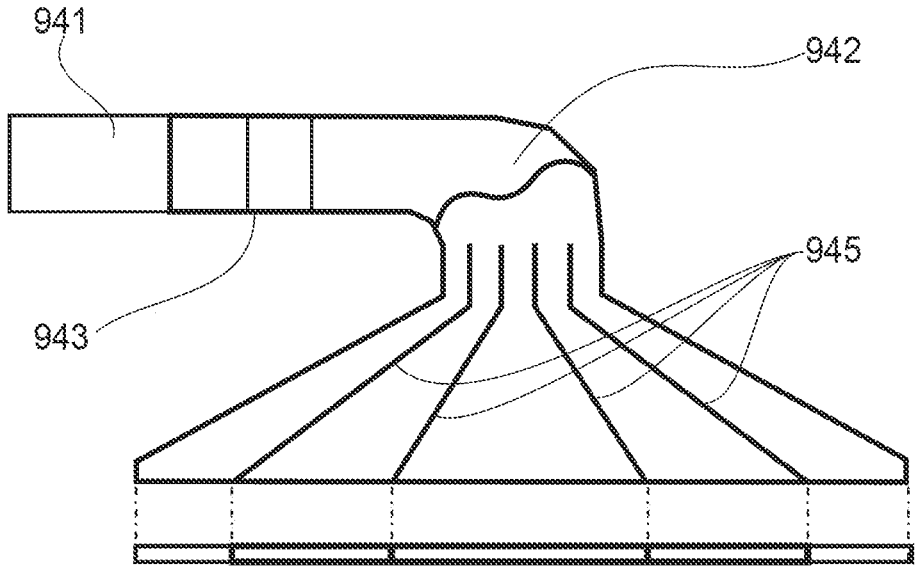
FIG. 4 is a sectional view of the separating means with respect to a conveyance-width direction in First Embodiment of the present invention.

Further, as shown in FIG. 4, the inside of the duct 942 is divided by a plurality of partition plates 945 so that a plurality of flow paths are arranged along a conveyance-width direction of the recording material. Further, with respect to the recording-material-conveyance-width direction, a ratio of an outlet portion cross-sectional area to an inlet portion cross-sectional area of an end portion flow path is constituted so as to be smaller than that of a central portion flow path. As a result, a distribution of the air speed at the outlet-side opening B of the duct 942 with respect to the recording-material-conveyance-width direction is higher at the end portion than at the central portion.

Thus, as will be described below by comparison with Comparative Embodiment, the recording material passing through the fixing nip is separated from the end portions, so that the separation is started with a smaller force.

Comparative Embodiment

Figure 9:
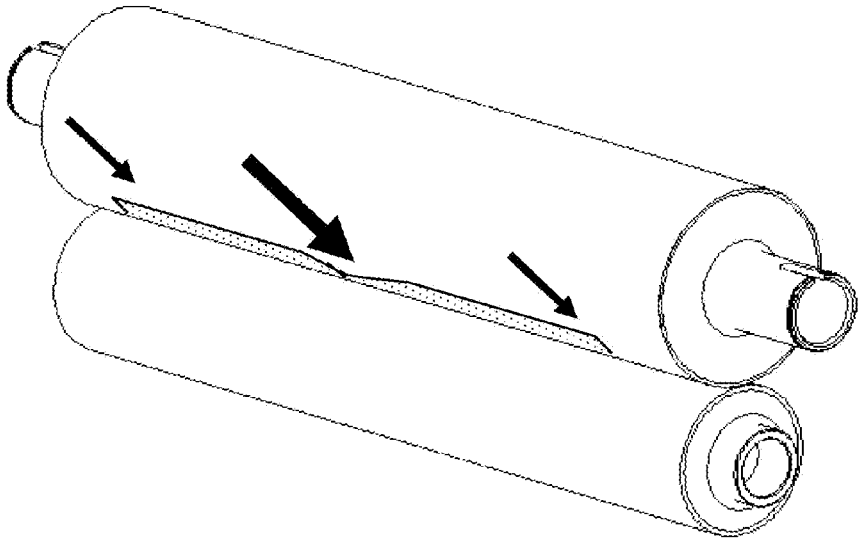
FIG. 9(A) is a perspective view schematically illustrating a moment of separation in the case where the separation is performed from a central portion of a recording material.
FIG. 9(B) is a perspective view schematically illustrating the moment of separation in the case where the separation is performed from end portions of the recording material.
Figure 9:
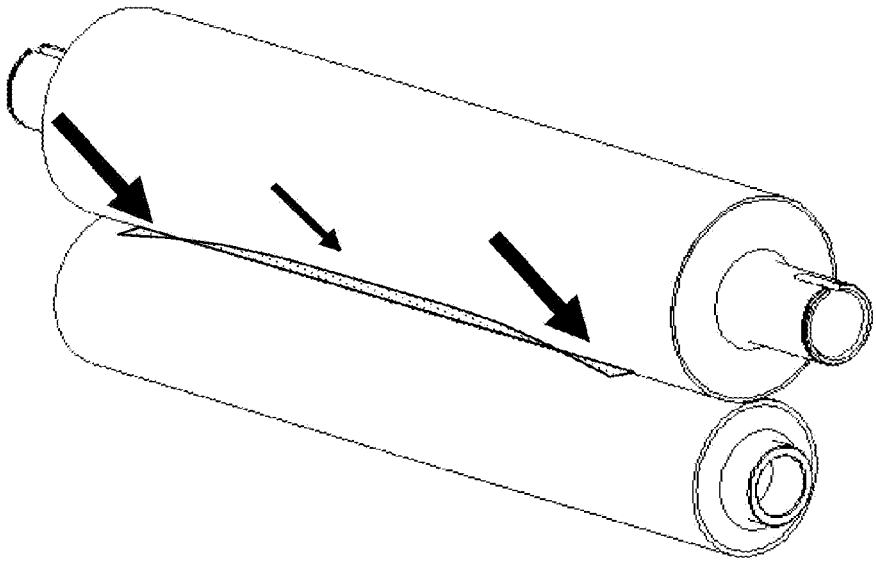

FIGS. (9A) and 9(*b*) are perspective views each for illustrating a state in which the recording material is separated from the fixing roller immediately after passing through the fixing nip. As shown in FIG. 9(A), when a distribution of an amount of the gas blown from nozzles is set so that the distribution at the central portion is higher than that at the end portions with respect to the recording-material-conveyance-width direction, the separation of the recording material is performed with a trigger that the central portion of the recording material is first separated. For this setting, first of all, there is a need to blow compressed gas so as to create a gap between the fixing member and the recording material at the central portion. In order to create a space between the fixing roller and the recording material at the central portion in a state in which the recording material is stuck on the fixing roller at the end portions, the necessary air speed becomes large. Further, it takes much time until the separation of the recording material proceeds until the end portions and thus a state in which the recording material is separated from the fixing roller at the central portion but is still stuck on the fixing roller at the end portions is maintained for a certain time, so that a difference in glossiness occurs between the central portion and the end portions of the recording material leading end portion.

On the other hand, as shown in FIG. 9(B), in the case where the separation of the recording material is performed from the end portions, first, the air speed, necessary to separate the end portions, as the trigger may only be required to be relatively small. Further, the separation proceeds simultaneously from the end portions toward the central portion and therefore the time difference until the recording material is separated at the central portion can be reduced, so that it becomes possible to reduce the degree of image defect, such as uneven gloss or the like.

(Measurement of Attraction Force for Attracting Recording Material to Fixing Roller)

In order to check the necessary air speed for the recording-material separation through an experiment, the attraction force for attracting the recording material after the fixing to the fixing roller was measured by using a known fixing device having the following specifications.

Fixing roller structure: The fixing roller included an aluminum metal core formed in a cylindrical shape of 71 mm in inner diameter, 77 mm in outer diameter and 350 mm in length and included a 3 mm-thick elastic layer, which was located on the outer peripheral surface of the metal core and was formed of a silicone rubber (JIS-A rubber hardness: 13 degrees). Further, the fixing roller included, as a surface layer, a 30 μm-thick coating layer of a PFA tube.

Fixing roller surface temperature: The fixing roller was temperature-contacted at 145° C.

Fixing nip pressure: 960-1000 N (98-102 kgf).

Sheet: "View Corona S" mfd. by Oji Paper Co., Ltd. (A4 size, basis weight: 38 g/m$^2$). This sheet was small in basis weight and free from stiffness, and was conveyed in landscape orientation.

Toner: A color pulverization toner (average particle size: 5.5 μm) for an oil-less fixing device was used.

Unfixed image: Cyan and magenta (two color) toner images were transferred on the sheet in a substantially whole area while leaving margins of 2 mm at leading end portion, trailing end portion and left and right end portions of the sheet. The toner amount is 0.55 (mg/mm$^2$) for each of the cyan and magenta toners.

Figure 5:
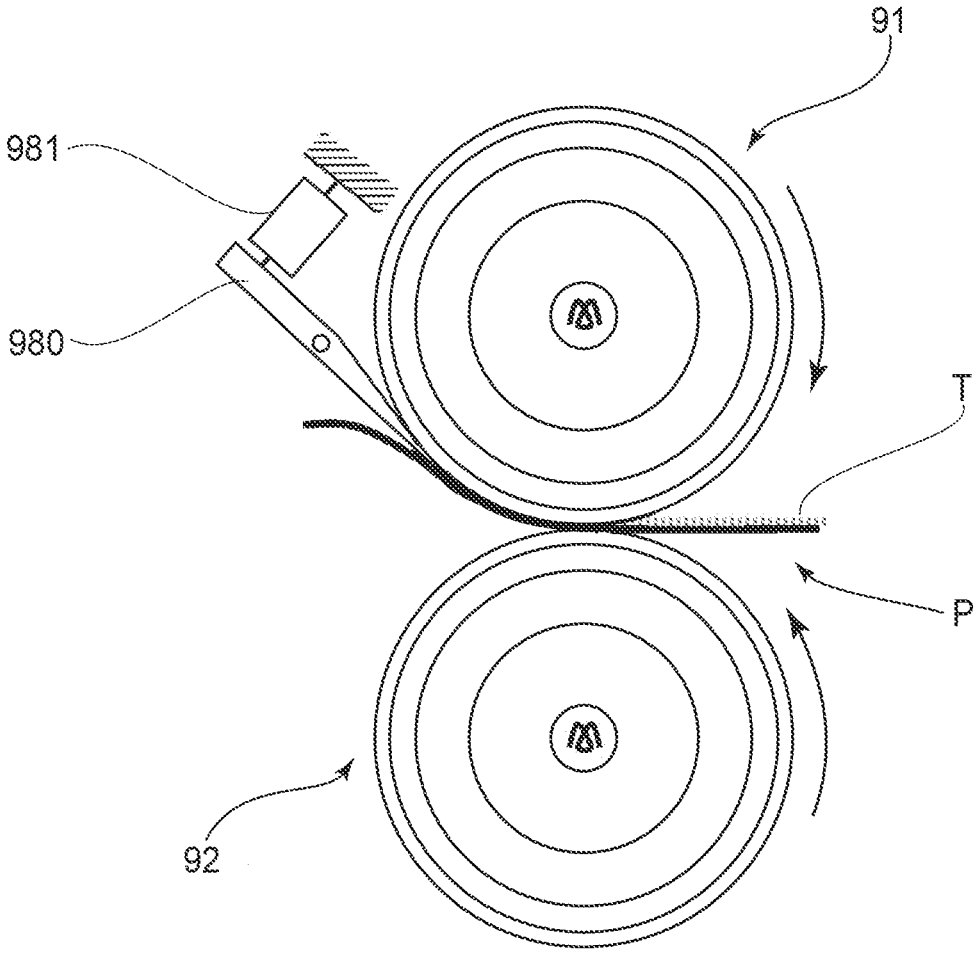
FIG. 5 is a sectional view schematically illustrating a recording-material-attraction-force measuring apparatus used in an experiment.

Here, as shown in FIG. 5, a load cell 981 was attached to a separation claw 980 (rotatable about a supporting point indicated by a while circle) contacted to the fixing roller 91. The load cell detected a mechanical acting force when the recording material stuck on the fixing roller 91 at a free end side of the separation claw 980 was separated, i.e., a force corresponding to the attraction force.

In this way, the unfixed image of the toner T placed on the recording material P was prepared on the basis of the above-described specifications. Then, when the unfixed image passed through the fixing nip pressed and heated by the fixing roller 91 and the pressing roller 92, the recording material P stuck on the fixing roller 91 was separated from the fixing roller 91 by the separation claw 980. When the force exerted on the separation claw 980 was measured several times, the force was 50 (mN) at the maximum.

In the case where the separation was performed by the gas ejected from the duct, there was a need to generate pressure exceeding this force. A force F (N) received by the recording material by the blowing of the ejected gas on the leading end portion margin of the recording material was determined by contact pressure Pr (N/m$^2$) exerted on the leading end portion margin and an area S (m$^2$) of the leading end portion margin on which the ejected gas was blown, and was specifically determined by the following formula:

$$F=Pr\cdot S=\tfrac{1}{2}\rho\cdot v^2\cdot S,$$

wherein ρ (kg/m$^3$) was a density of the gas and v (m$^2$/sec$^2$) was a speed of the ejected gas. From this formula, in the case where the temperature of the ejected gas was 27° C., in order to separate the recording material at the leading end portion margin of 2 mm of the A4-sized paper subjected to landscape feeding, the speed of the ejected gas was required to be 12 (m/sec) at the lowest.

In this embodiment, a distribution of the speed of the gas ejected from the duct 942 was set at 12-14 (m/sec) for the central portion and 15-20 (m/sec) for the end portions, so that the air speed at the end portions was higher than that at the central portion.

Thus, the air speed was different between the central portion and the end portions of the recording material and therefore the area, necessary to separate the recording material, in which the ejected gas in blown on the recording material was different. That is, at the end portions, the air speed was 15-20 (m/sec) and therefore the separation was performed at the time when the leading end portion was exposed from the fixing nip by 0.72-1.27 (mm). Further, at the central portion, the air speed was 12-14 (m/sec) and therefore the separation was performed at the time when the leading end portion was exposed from the fixing nip by 1.46-2 (mm). Therefore, the time of start of the separation was different between the end portions and the central portion, so that the separation was effected from the end portions toward the central portion. In this embodiment, the conveyance speed of the recording material is 300 (mm/sec) and therefore a time from start of the separation at the end portions to end of the separation in the entire area with respect to the recording-material-conveyance-width direction can be suppressed within 10 (msec). As a result, the degree of the image defect, such as the uneven gloss between the central portion and the end portions, was alleviated.

The speed at the opening B of the duct 942 depends on the ratio between the inlet cross-sectional area and the outlet cross-sectional area of the duct 942. In order to accelerate the end portion speed up to 15-20 (m/sec) compared with the central portion speed of 12-14 (m/sec), there is a need to make the end portion outlet cross-sectional area at the opening blow narrower than the central portion outlet cross-sectional area at the opening blow, so that a ratio of the end portion outlet cross-sectional area to the central portion outlet cross-sectional area may preferably be about 0.3-0.6.

In this case, when only the outlet cross-sectional area is changed, it would be considered that an end-portion-flow-path resistance is increased and compared with the central portion, the amount of the gas flowing into the end portion flow paths is decreased and thus the air speed at the flow path outlets is decreased. For that reason, the inlet cross-sectional area of each flow path may more preferably be set so that the amount of the gas flowing into each flow path is uniformized. Whether or not the gas amount is uniformized when the ratio of the end portion flow path inlet cross-sectional area to the central portion flow path cross-sectional area is to what extent varies depending on the duct shape but it is preferable that the inlet cross-sectional area at the end portion flow paths is made larger than that at the central portion flow path.

Figure 6:
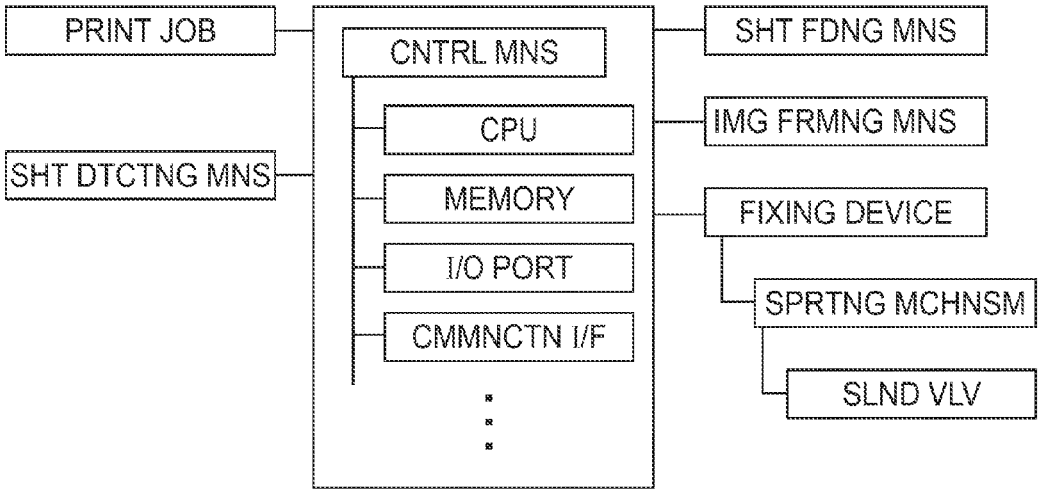
FIG. 6 is a block diagram in First Embodiment of the present invention.

FIG. 6 is a block diagram showing a contact system of the image forming apparatus including the fixing device according to the present invention. The control means is constituted by a computing unit including CPU and a memory and circuits or the like, for transferring data to an external device, such as I/O port and a communication interface. The control means executes a plurality of programs stored in the memory sequentially depending on a situation.

In the case where a large thickness sheet or the like is used as the recording material, paper stiffness is strong and therefore a force for separating the sheet from the fixing roller by rigidity of the sheet exceeds the adhesive force of the sheet to the fixing roller by the melted toner, so that the sheet can be separated without blowing the gas. Therefore, it is preferable that an operation of the solenoid valve of the transfer-material separating mechanism is controlled depending on the thickness of the recording material and thus the gas is blown on only small thickness paper.

Second Embodiment

Figure 7:
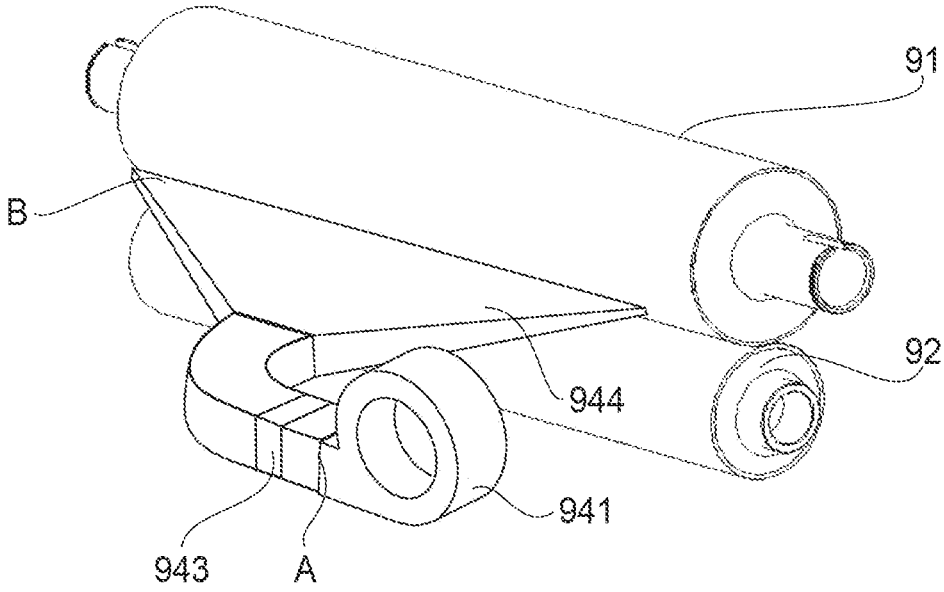
FIG. 7(A) is a perspective view of a fixing device provided with a separating means in Second Embodiment.
FIG. 7(B) is a sectional view of the separating means with respect to the conveyance-width direction.
Figure 7:
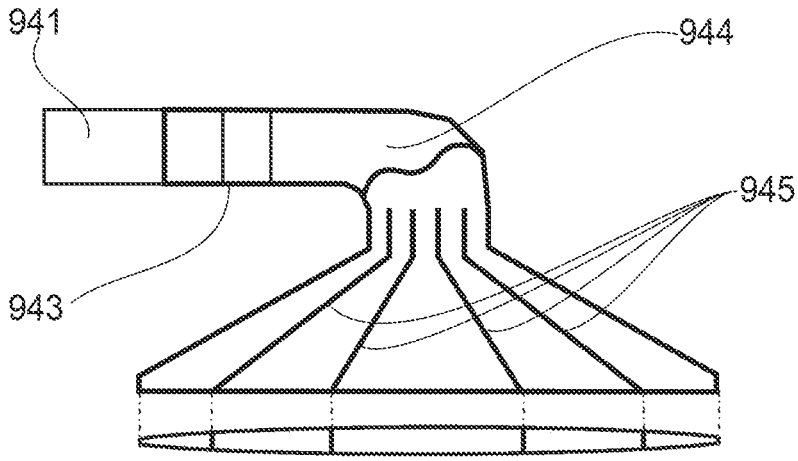

A fixing device using a recording-material separating mechanism in this embodiment will be described with reference to FIGS. 7(A) and 7(B). This embodiment is only different in duct shape from First Embodiment. As shown in FIG. 7(A), the recording-material separating mechanism is constituted, similarly as in First Embodiment, by the air blowing fan 941, the solenoid valve 942 and a duct 944. FIG. 7(B) is a sectional view of the duct 944. Similarly as in First Embodiment, the shape of the opening blow of the duct 944 is the rectangular shape elongated in the longitudinal direction of the fixing roller 91 but the width (height) of the opening blow is wide at the central portion and is narrow at the end portions with respect to the conveyance-width direction.

According to this constitution, compared with First Embodiment, the end portion flow path cross-sectional area can be further decreased, so that the end portion air speed can be further increased.

Third Embodiment

Figure 8:
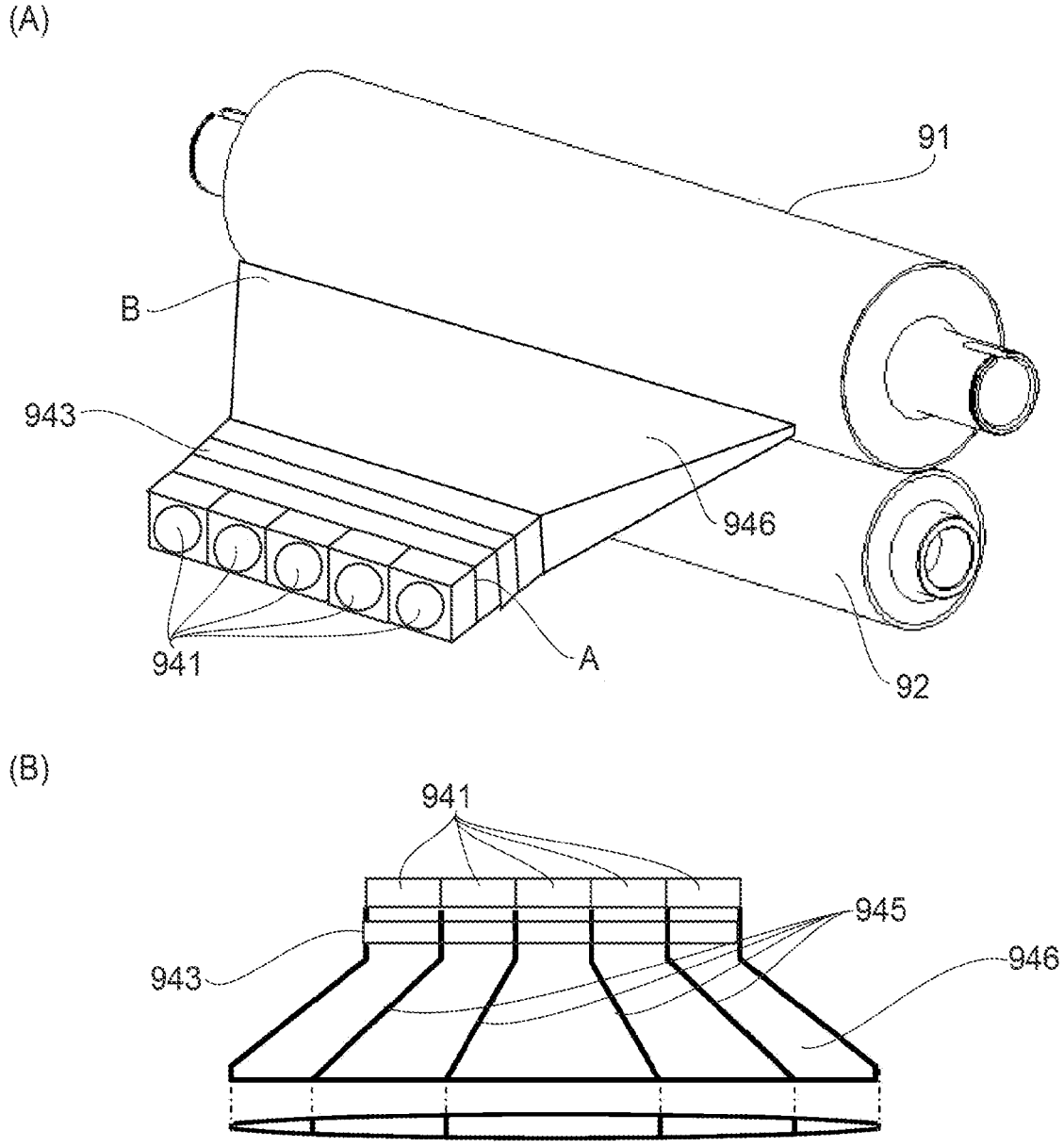
FIG. 8(A) is a perspective view of a fixing device provided with a separating means in Third Embodiment.
FIG. 8(B) is a sectional view of the separating means with respect to the conveyance-width direction.

With reference to FIGS. 8(A) and 8(B), a fixing device using a recording-material separating mechanism in this embodiment will be described. Also in this embodiment, the same constitution is employed except that the recording-material separating mechanism is different from that in First Embodiment and therefore a detailed description of the constituent portions identical to those in First Embodiment is omitted.

As shown in FIG. 8(A), the recording-material separating mechanism employs a constitution in which a duct 946 and a plurality of air blowing fans 941 arranged at the inlet opening A of the duct 946 with respect to the recording material conveyance-width direction are connected. As shown in FIG. 8(B), inside the duct 946, similarly as in the duct 944 in Second Embodiment, the partition plates 945 are disposed so that a plurality of flow paths are provided along the recording material conveyance-width direction.

At the inlet opening A of the duct 946, the cross-sectional area of each of the flow paths is equally set. At the outlet opening B, similarly as in Second Embodiment, the cross-sectional area is large at the central portion and small at the end portions. As a result, the ratio of the outlet cross-sectional area to the inlet cross-sectional area at the flow paths inside the duct 946 is set so that the ratio at the end portions is smaller than that at the central portion.

In this embodiment, the plurality of air blowing fans 941 provided independently for the flow paths of the duct 946, respectively are attached to the inlet opening A, so that the gas sent into each of the flow paths is supplied from an associated one of the air blowing fans 941.

In First and Second Embodiments, the single air blowing fan is used and therefore the gas is supplied from the single air blowing fan to each of the flow paths. With a decrease in ratio of the flow path outlet cross-sectional area to the flow path inlet cross-sectional area, the resistance when the gas flows into the flow paths becomes large. For that reason, it was considered that there is the case where it is difficult to uniformize the amount of the gas (air) supplied to each flow path depending on selection of the air blowing fan or the duct shape. On the other hand, according to this embodiment in which the independent air blowing fans are provided for the flow paths, respectively, the amount of the gas supplied to each flow path can be uniformized. That is, according to this embodiment, even in the case where it is difficult to form a proper air-speed distribution by the single air blowing fan, it is possible to form the air-speed distribution such that the air speed at the end portions is higher than that at the central portion.

Fourth Embodiment

An image forming apparatus in this embodiment includes a recording-material-thickness detecting means, and the control of the solenoid valve of the recording-material separating mechanism is effected so that the thickness of the recording material is detected and the gas in blown on only the recording material having a thickness in which the separation cannot be performed until the recording-material separating mechanism is operated. That is, in the case where the thickness of the recording material exceeds a predetermined value, irrespective of the gas introducing member, a determination that the recording material is separable from the fixing member is made and then the control is effected so that the amount of the gas sent from the gas introducing member is made zero.

Figure 10:
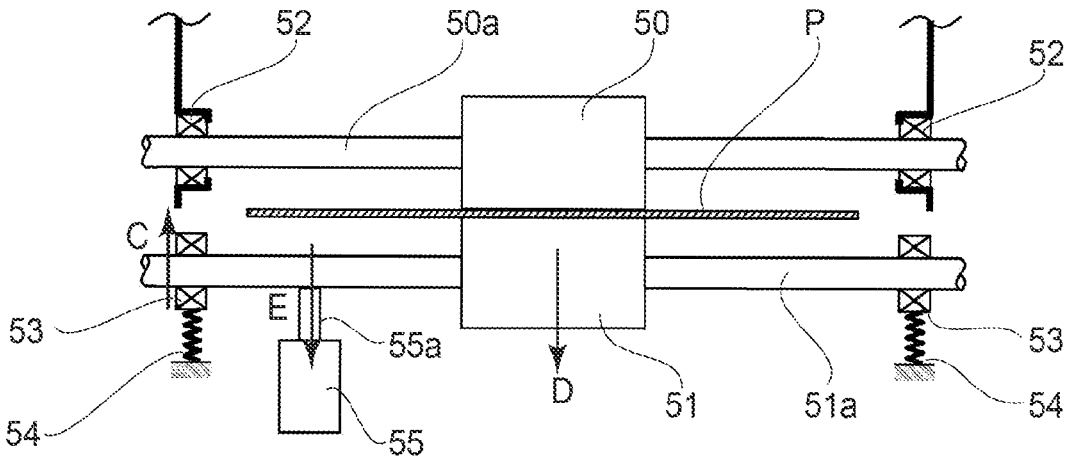
FIG. 10(A) is a sectional view for illustrating Fourth Embodiment in which a recording-material-thickness detecting means is provided.
FIG. 10(B) is a block diagram regarding recording material thickness detection.
Figure 10:
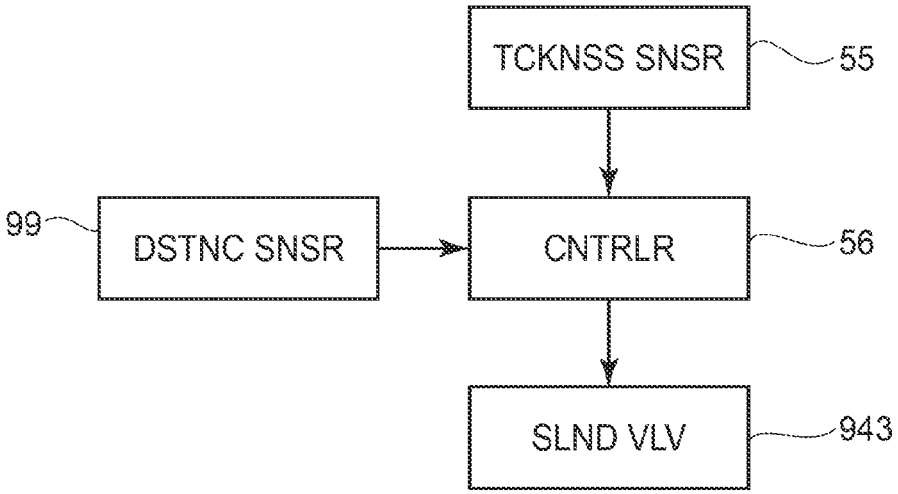

FIG. 10(A) is a schematic sectional view showing the recording-material-thickness detecting means. The recording-material-thickness detecting means is constituted by a roller pair of paper thickness detecting rollers 50 and 51 (FIG. 2) and is disposed upstream of the transfer roller 10 with respect to the recording-material conveyance direction. In the figure of the recording-material-thickness detecting means, a roller shaft 50*a* of the paper thickness detecting roller 50 is firmly positionally fixed to the apparatus main assembly by bearing 52 at its end portions. Bearings 53 mounted at end portions of a roller shaft 51*a* of the lower paper thickness detecting roller 51 are attached to urging springs 54 and are urged upward in the figure (in an arrow C direction), so that the paper thickness detecting roller 51 is pressed against the paper transfer material detecting roller 50. Therefore, when the recording material P passes between the paper thickness detecting rollers 50 and 51, by the thickness of the recording material P, the paper thickness detecting roller 51 is moved in an arrow D direction and presses down a shaft 55*a* of a paper thickness detecting sensor 55 in an arrow E direction in the figure. Then, the paper thickness detecting sensor 55 outputs a voltage value corresponding to an amount of movement of the shaft 55*a* and sends the voltage value to a control circuit described below.

In FIG. 10(B), the output (voltage value) depending on the thickness of the recording material passing through the gap between the paper thickness detecting rollers 50 and 51 is sent from the paper thickness detecting sensor 55 to a control circuit 56. Only in the case where the obtained paper thickness is the thickness in which the recording material cannot be separated until the recording-material separating mechanism is operated, the control circuit 56 operates the solenoid valve. The time when the solenoid valve is opened is about 1.5-2.0 sec after a distance sensor 99 located upstream of the fixing nip of the fixing device detects the entering of the paper. In this embodiment, a threshold is set so as to open the solenoid valve only in the case where information outputted from the paper thickness detecting sensor 55 is a predetermined value or less, e.g., 70 μm or less as the thickness of the recording material. That is, in the case where the paper thickness exceeds the predetermined value of, e.g., 70 μm, a determination that the recording material is separable from the fixing member irrespective of the gas introducing member is made and the control is effected so that the amount of the gas sent from the gas introducing member is made zero. Further, in the case where the paper thickness does not exceeds 70 μm, the control is effected so that the amount of the gas sent from the gas introducing member is increased with a decrease in thickness of the recording material. That is, the recording material is determined as being less separated with a thinner paper and the air amount is increased.

Here, the paper thickness is detected by the paper thickness detecting sensor 55 and can be converted into the basis weight, so that the control of the air amount depending on the basis weight of the recording material can be effected. Specifically, in the case of 60 g/m$^2$ or less in basis weight, the recording material is regarded as the thin paper, so that the gas is introduced from the gas introducing member. Further, in the case where the basis weight is 60 g/m$^2$ or less, the air amount is controlled so as to be increased with a decrease in basis weight.

Fifth Embodiment

Figure 11:
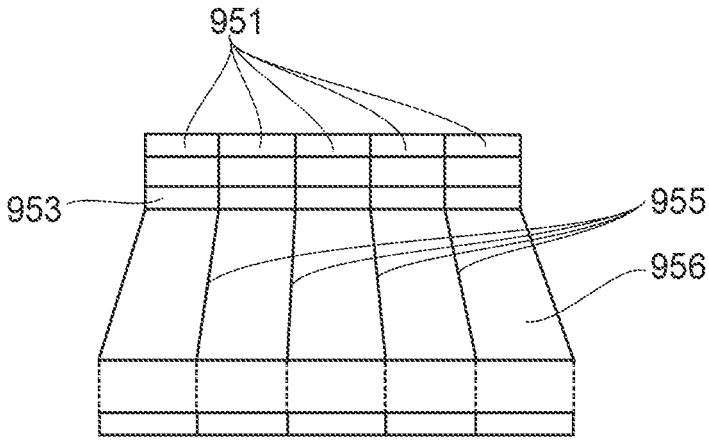
FIG. 11 is a sectional view of a separation means with respect to a longitudinal direction in Fifth Embodiment of the present invention.

In this embodiment shown in FIG. 11, similarly as in Third Embodiment, the flow paths of a duct 956 partitioned by a plurality of partition plates 955 are provided with independent air blowing fans 951 and solenoid valves 953, respectively. However, thickness is different from Third Embodiment in that the ratio of the flow path outlet cross-sectional area to the flow path inlet cross-sectional area is constant with respect to the conveyance-width direction (the flow path outlet width (height) is also constant with respect to the conveyance-width direction). In this embodiment, in the case where air blowing power of each air blowing fan 951 is the same, the number of rotations of the fan is controlled (PPW control) so as to be larger at the end portions than that at the central portion. Further, the air blowing power of each air blowing fan 951 is different, an air blowing means having the air blowing power such that the power at the end portions is higher than that at the central portion is used.

Sixth Embodiment

Figure 12:
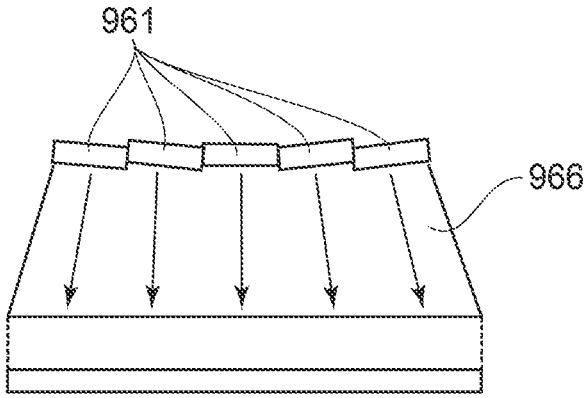
FIG. 12 is a sectional view of a separation means with respect to the longitudinal direction in Sixth Embodiment of the present invention.

In this embodiment shown in FIG. 12, similarly as in Fifth Embodiment, the flow path outlet width (height) is constant with respect to the conveyance-width direction. In this embodiment, a duct 956 is not provided with a partition plate, and independent air blowing fans 961 are inclined with respect to the nip, so that directivity of the air blow is provided. In the case where the air blowing power of each air blowing fan 961 is the same, the number of rotations of the fan is controlled (PPW control) so as to be larger at the end portions than that at the central portion. Further, the air blowing power of each air blowing fan 961 is different, an air blowing means having the air blowing power such that the power at the end portions is higher than that at the central portion is used.

The air speed can be considered as the air amount per unit area. In order to form the air speed distribution, in addition to change the ratio of the outlet cross-sectional area to the inlet cross-sectional area between the central portion and the end portions, it would be considered that the above-described constitutions are employed.

(Plural Types of Recording Materials Different in Conveyance Width)

With respect to the separation of a plurality of types of the recording materials different in conveyance width, in the case where the plurality of types of the recording materials are conveyed into the nip on the basis of the same center line conveyance, a common air speed distribution can be applied to the plurality of types of the recording materials irrespective of the conveyance width.

(Type of Fixing Device)

IN the present invention, the type of the fixing device may include a type in which the unfixed image is heat-fixed at the press-contact portion of the pair of the heating roller and the pressing roller, a type in which the unfixed image is press-fixed at the press-contact portion of a pressing roller pair, and the like. Further, the heat fixing type may include a heating roller type, a film heating type, a type using electromagnetic induction heating (IHF). Further, in the case where the endless belt is used, the fixing device may include a fixing device in which a roller and an endless belt are used in combination as a pair and an upper and lower belt fixing device in which upper and lower (two) endless belts are opposed and press-contacted to each other. Further, the fixing device may include a device for fixing the unfixed toner image on the recording material as a fixed image and a device for increasing the glossiness of the image by re-heating the image fixed on the recording material.

According to the present invention, with the trigger that the separation of the recording material at the end portions with respect to the conveyance-width direction is started, the separation of the recording material is performed. Therefore, compared with the case where the separation of the recording material is performed with the trigger that the recording material separation is started at the central portion with respect to the conveyance-width direction, the time different from the end portion separation until the central portion separation can be reduced. Further, the degree of the image defect such as the uneven gloss can be reduced.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 170514/2010 filed Jul. 29, 2010, which is hereby incorporated by reference.

What is claimed is:

1. A fixing apparatus comprising:

first and second rotatable members configured to fix an unfixed toner image on a sheet by heat and pressure in a nip portion therebetween; and a separation mechanism configured to separate the sheet from said first rotatable member, wherein said separating mechanism includes an ejecting device configured to eject air toward a surface of said first rotatable member, which is adjacent to an exit of the nip portion, so that the speed of the air flowing toward the first rotatable member at both end portions of the ejecting device is higher than that flowing toward the first rotatable member at a central portion of the ejecting device with respect to a longitudinal direction of said first rotatable member, when a fixing process for a predetermined type of the sheet is executed.

2. A fixing apparatus according to claim 1, wherein said ejecting device includes an air supplying device configured to supply the air and a duct configured to permit the flow of the air from said air supplying device toward said first rotatable member, and wherein an inside of said duct is partitioned by a plurality of partition plates so as to include a plurality of air flow paths in the longitudinal direction.

3. A fixing apparatus according to claim 2, wherein a ratio of an outlet cross sectional area of said duct to an inlet cross sectional area of said duct in both end portions thereof is smaller than that of a central portion thereof.

4. A fixing apparatus according to claim 2, wherein an inlet cross sectional area of said duct at both end portions thereof is larger than that at the central portion thereof.

5. A fixing apparatus according to claim 4, wherein an outlet cross sectional area of said duct at the both end portions thereof is smaller than that at the central portion thereof.

6. A fixing apparatus according to claim 1, further comprising a controlling device configured to control an ejection amount of the air ejected by said ejecting device based on information corresponding to a thickness of the sheet.

7. A fixing apparatus according to claim 6, wherein when the thickness of the sheet exceeds a predetermined value, the controlling device makes the ejection amount substantially zero.

8. A fixing apparatus according to claim 6, wherein when the thickness of the sheet is decreased, the controlling device controls the ejection amount of the air ejected by said ejecting device so as to be increased.

9. A fixing apparatus according to claim 1, wherein said first rotatable member is disposed so as to contact the unfixed toner image on the sheet.

10. A fixing apparatus according to claim 1, further comprising a heater configured to heat said first rotatable member.

11. A fixing apparatus according to claim 10, wherein said first rotatable member is a roller, and said heater is disposed in said roller.

12. A fixing apparatus according to claim 2, wherein said ejecting device includes a valve device configured to turn on and off the passing of the air supplied by said air supplying device.

* * * * *